United States Patent [19]

Yukl

[11] Patent Number: 4,878,059

[45] Date of Patent: Oct. 31, 1989

[54] FARFIELD/NEARFIELD TRANSMISSION/RECEPTION ANTENNA

[75] Inventor: Tex Yukl, Baker, Oreg.

[73] Assignee: Spatial Communications, Inc., Baker, Oreg.

[21] Appl. No.: 524,533

[22] Filed: Aug. 19, 1983

[51] Int. Cl.[4] ..... H01Q 19/06

[52] U.S. Cl. ..... 343/753; 343/908

[58] Field of Search ..... 343/786, 753–755, 343/741, 789, 785, 909, 911 R, 908, 833, 834, 842, 742

[56] References Cited

U.S. PATENT DOCUMENTS

| | | | |
|---|---|---|---|
| RE23,051 | 11/1948 | Carter | 343/786 |
| 2,232,179 | 2/1941 | King | 343/786 |
| 2,273,447 | 2/1942 | Ohl | 343/786 |
| 2,398,095 | 4/1946 | Katzin | 343/786 |
| 2,596,190 | 5/1952 | Wiley | 343/786 |
| 2,669,657 | 2/1954 | Cutler | 343/786 |
| 2,791,770 | 5/1957 | Risser | 343/786 |
| 3,491,361 | 1/1970 | Campbell | 343/833 |
| 4,234,844 | 11/1980 | Yukl | 324/58.5 A |
| 4,313,122 | 1/1982 | Duppressoir et al. | 343/789 |
| 4,318,108 | 3/1982 | Yukl | 343/753 |

*Primary Examiner*—Rolf Hille
*Assistant Examiner*—Michael C. Wimer
*Attorney, Agent, or Firm*—Kolisch, Hartwell & Dickinson

[57] ABSTRACT

A nearfield/farfield transmission/reception antenna formed with a body of revolution having a somewhat saucer-like outside appearance. The body includes three main functional portions—a converter portion wherein farfield radiation is converted to "appear" like nearfield radiation and vice versa, a terminator portion which provides a constant-impedance termination for the converter portion, and a coupling-impedance transformer portion which matches the device to the impedance of a coaxial port in an external circuit. A ring-like driven element occupies an interface plane between the converter and terminator portions. Distributed on the outside curved surface of the body is a conductive electromagnetic/electrostatic shield.

3 Claims, 2 Drawing Sheets

FARFIELD/NEARFIELD TRANSMISSION/RECEPTION ANTENNA

BACKGROUND AND SUMMARY OF THE INVENTION

This invention pertains to a uniquely shaped transmission/reception antenna which is characterized by compact size, and extremely high-gain, high-efficiency operation given its small size. While the proposed antenna, as has just been stated, is operable in both transmission and reception operating modes, a preferred embodiment of the invention is described herein in a reception-mode setting, wherein it has been found to have particular utility, as, for example, in the reception of satellite-transmitted signals.

A fundamental problem which characterizes prior art antenna designs, for example for high-frequency (multiple gigahertz) operation, is that they are usually extremely large in their intended environment, and function with relatively low gain and low efficiency. Ubiquitous in the genre of such antennas, like satellite-transmission/reception antennas, are the so-called parabolic dish antennas which are extremely large, typically, and bulky and expensive.

A general object of the present invention is to provide a unique form of antenna, of the type generally suggested above in the opening paragraph, which significantly overcomes the principal deficiences of prior art antennas like those just mentioned.

More particularly, an object of the invention is to provide a relatively low-cost, extremely compact antenna which, in relation to its compactness, is capable of extremely high-gain, high-efficiency (the ratio: actual gain/theoretical gain)$\times$100 operation.

I have discovered that through the careful mathematical shaping of a solid-body polystyrene material, such as the material known as Q200.5 "Polypemco", distributed by Emmerson & Cummins, it is possible easily to realize the principal objects of the invention, just set forth above.

In the description which follows below of my new antenna, I use the terms "nearfield" and "farfield". By these terms, I mean the following: farfield electromagnetic radiation is that which appears to occur over huge distances, wherein radiation "wavefronts" appear to be substantially planar. Nearfield radiation is that which appears to occur relative to an object which is extremely close, for example, within one-half to one-quarter wavelength of the associated operating frequency. In this kind of a setting, radiation wavefronts are strictly nonplanar, and in particular, are extremely curvilinear.

Antennas which are designed in accordance with the disclosure herein, are capable of operating with gains of up to about 40-db, and efficiencies as high as about 85-percent.

According to a preferred embodiment of the invention, which is illustrated in the drawings and described below, the proposed antenna, when viewed from the outside, has what might be thought of a saucer-like outside appearance. The antenna is formed with a body of revolution which includes three main functional portions:

1. An outwardly flared and inwardly converging converter portion extending between front and back planes, wherein what may be referred to as a farfield response occurs in the outwardly facing front plane, and a nearfield response occurs adjacent the back plane;

2. A terminator portion which is joined integrally with the converter portion to provide constant-impedance termination for the converter portion, with the terminator portion characterized by inside and outside curved convergence progressing away from the converter portion; and 3. A coupling-impedance transformer portion having a cylindrical outside, and a curved, convergent inside, which serves to match the overall antenna to the impedance of a selected coaxial port in an external electrical circuit.

Further included in the antenna is a ring-like driven element which resides at the interface plane between the converter and terminator portions—the central plane in the antenna. This ring couples through an axial conductor, and through the transformer portion, to a port of the type mentioned above. Distributed over the radially outwardly facing outside surface of the antenna is a conductive electromagnetic/electrostatic shield.

These and other features, objects and advantages relating to the invention will become more fully apparent as the description which now follows is read in conjunction with the accompanying drawings.

DETAILED DESCRIPTION OF THE INVENTION

1. Definitions and Design Formulae

Set forth below are definitions (mathematical and verbal) presenting, in general terms, the design parameters necessary, for any chosen operating frequency, properly to construct an antenna in accordance with the present invention. How these parameters are employed will appear more particularly in the discussion which follows below.

$K$ = $K$ factor = 0.9561

$f_o$ = chosen operating frequency $f_d$ = design operating frequency = $\frac{f_o}{K}$ $\lambda_a = \frac{V_a}{f_d}$ where: $\lambda_a$ = wavelength in air, and $V_a$ = propagation velocity in air -continued $$\lambda_1 = \frac{V_1}{fd}$$ where: $\lambda_1$ = wavelength in the antenna body material, and $V_1$ = propagation velocity in the same material $$Z_o = 138\left[\log\frac{D_o}{D_i}\right]\left(\frac{V_1}{V_a}\right) = \text{coupled coaxial output impedance}$$

where; $D_o$ = inside diameter of outer coaxial conductor in coupling port $D_i$ = outside diameter of inner coaxial conductor in coupling port $$A_1 = \frac{\lambda_a}{2\pi}$$

$$A_2 = 0.1\,\lambda_1 + \frac{\lambda_a}{2\pi}$$

$$A_3 = \frac{D_o}{2}$$

$$\text{Gain} = 10\log\left[\frac{\text{input aperture area} \times K_1}{\text{output aperture area} \times K_a}\right]$$

where; $K_1$ = dielectric constant of the antenna body material, and $K_a$ = dielectric constant of air $R_{ic}$, $R_{oc}$, $R_{it}$, $R_{ot}$, $R_{itr}$ and $R_{otr}$ are different radical distances from the symmetry axis of the antenna

2. The Preferred Embodiment

Figure 1:
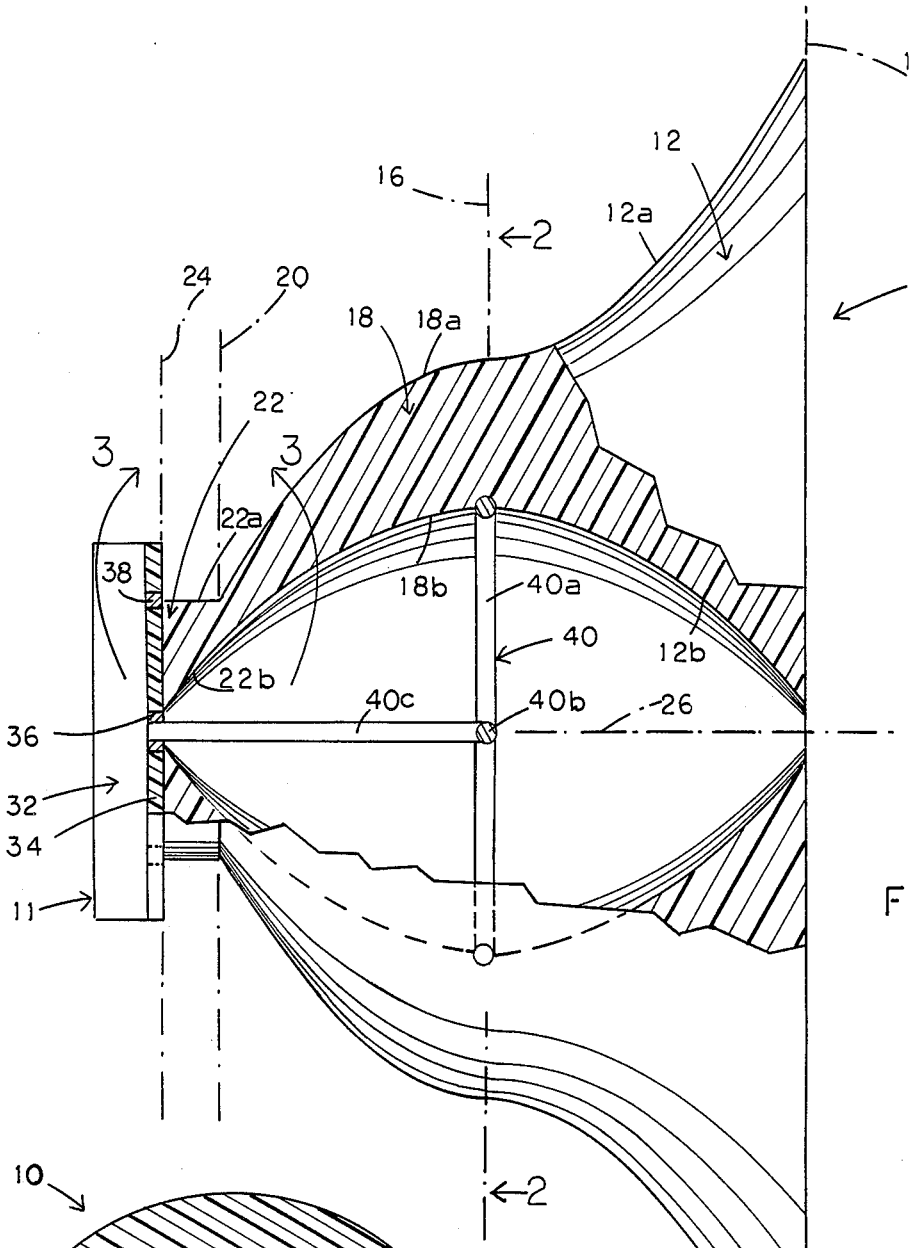
FIG. 1 is a side elevation of an antenna constructed in accordance with the present invention, with certain portions broken away to illustrate details of construction, and with proportions in certain parts of the antenna intentionally distorted so as to enable full presentation on a single page of drawings with an acceptable drawing scale.
Figure 4:
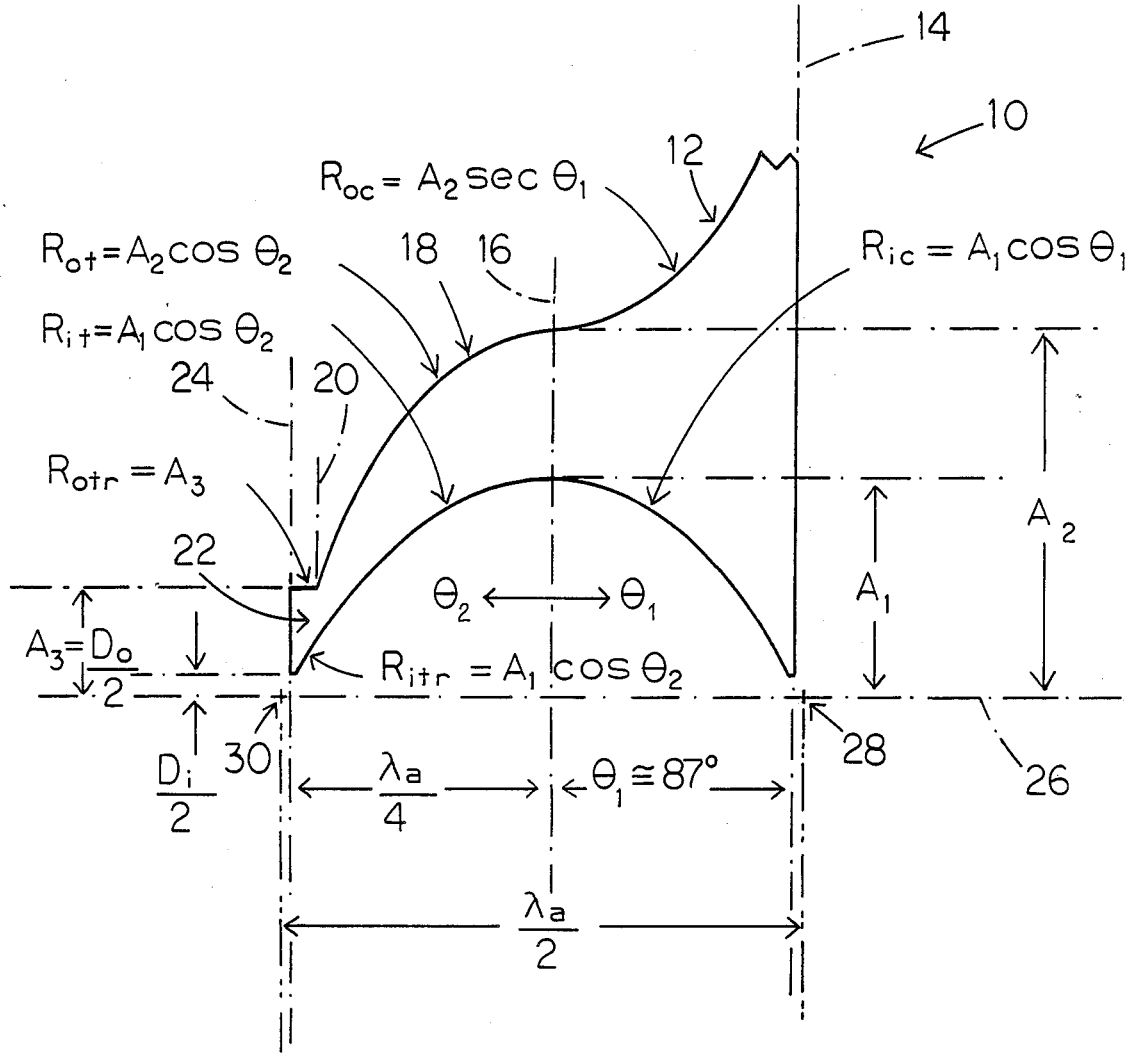
FIG. 4 is a schematic fragmentary view of the upper half of the antenna of FIG. 1, marked to indicate important dimensions and design parameters.

Turning now to the drawings, and referring first to FIGS. 1 and 4, indicated generally at 10 is a nearfield/-farfield, transmission/reception antenna constructed in accordance with the present invention. As was mentioned earlier, antenna 10 is illustrated herein coupled to an external circuit 11 (FIG. 1), which will be mentioned more fully later, for operation in a reception mode.

In general terms, antenna 10 includes three principal body portions, each of which takes the form of a body of revolution, and all of which are formed, in any suitable manner, as a unitary structure. These three body portions include a converter portion 12, which extends between the front plane of the antenna 14 and the central plane of the antenna 16, a terminator portion 18 which extends between central plane 16 and another plane shown at 20, and a coupling-impedance transformer portion 22 which extends between plane 20 and another plane 24 that defines what may be thought of as the rear plane of the antenna. Planes 14, 16, 20, 24 are substantially parallel to one another, and are normal to the axis of revolution of the antenna, shown at 26, which axis is also referred to herein as the transmission/reception axis for the antenna.

While different particular materials may be used commonly for these three body portions, one which has been found to be extremely suitable for most purposes is a polystyrene material sold under the name Polypemco Q200.5 (mentioned earlier).

Considering the configuration of converter portion 12, the same includes outer and inner surfaces of revolution **12*a*, 12*b*, respectively (see FIG. 1). Where these surfaces intersect any radial plane containing axis 26, such as the planes of FIGS. 1 and 4, they describe the curvilinear lines which are shown clearly in FIGS. 1 and 4. These lines extend between planes 14, 16, which planes are referred to, respectively, as the front and rear planes of portion 12**.

With reference for a moment particularly to FIG. 4, indicated centrally in this figure, by an arrow extending to the right of plane 16, is an angular measurement scheme employing the angle defined as $\theta_1$. Angle $\theta_1$ increases from zero degrees at the location of plane 16 progressing to the right along axis 26.

The curvature of the line formed by the intersection of the planes of FIGS. 1 and 4 and the inner surface of revolution of converter portion 12 is described by the formula:

$$R_{ic} = A_1 \cos\theta_1$$

where $R_{ic}$ (Inside radius of Converter portion) is the radial distance of the line from axis 26, and $A_1$ is the constant set forth in the definitions section above in this disclosure. For a reason which will be more fully explained later, and as can be seen in FIGS. 1 and 4, the cosine-shaped line now being described terminates short of axis 26. Were it to be extended to axis 26 in accordance with the formula given above, it would intersect this axis at a point designated by the reference character 28 in FIG. 4. Point 28 is referred to herein as a quarter-wavelength point relative to the antenna, and this denomination will become apparent shortly.

The curved line resulting from radial plane intersection with the outer surface of revolution of portion 12 is defined by the formula:

$$R_{oc} = A_2 \sec\theta_1$$

where $R_{oc}$ (Outside radius of Converter portion) is the radial distance of the line from axis 26, and $A_2$ is the constant set forth above in the definitions section above.

If the front face of the antenna, defined in plane 14, were permitted to reside in a plane which intersected axis 26 at point 28, the point at which the first above-defined curvilinear line intersects axis 26, the outer surface of revolution of portion **12*a* would extend to infinity—an impossible situation. This impossibility is avoided by extending the front face of the antenna (along axis 26) close to, but nevertheless short of, point 28, in order to maintain the antenna at a reasonable size, regardless of operating frequency. Experience has shown that extending this front face to the location where $\theta_1$ approximately equals 87° is a very suitable choice. This is indicated at the base of FIG. 4**.

Still with reference to the above two formulae which define the two curved lines just discussed, one will note that the constant $A_1$ is equal to the radial distance from axis 26 to the point where a line in the inner surface of body portion 12 intersects axis 16. Similarly, the constant $A_2$ is equal to the radial distance from axis 26 to the point where a line in the outer surface of portion 12 intersects plane 16.

Discussing now, in similar terms, terminator portion 18, a line in the inner surface of revolution, **18*b* (see FIG. 1), of this portion, contained in the planes of FIGS. 1 and 4**, is described by the formula:

$$R_{it} = A_1 \cos\theta_2$$

where $R_{it}$ (Inside radius of Terminator portion) is the radial distance of this line from axis 26, and $\theta_2$ is an angle measured in FIG. 4 to the left of plane 16, as indicated, beginning with zero degrees at the location of plane 16.

Were the line in portion 18 just immediately above described extended to where it would intersect axis 26, such an intersection would take place at a point 30 (see FIG. 4) which is a mirror-image point, vis-a-vis point 28, relative to plane 16. Point 30, like point 28, is referred to herein as another quarter-wavelength point relative to the antenna. However, the line just described does not extend to this point for the reason that access must be provided, as will be explained, for coupling antenna 10 to an input port for previously mentioned circuit 11.

Continuing with the terminator portion, a line in the outer surface of revolution, 18*a* (see FIG. 1), of this portion, contained in the planes of FIGS. 1 and 4, is described by the formula:

$$R_{ot}=A_2 \cos \theta_2$$

where $R_{ot}$ (Outside radius of Terminator portion) is the radial distance of this line from axis 26.

Such a line, which terminates, for reasons that will be explained, at the location of plane 20, would, if extended to axis 26, intersect that axis at point 30.

Previously mentioned central plane 16, which is referred to as the rear plane of converter portion 12, is also referred to herein as the front plane of terminator portion 18. Put another way, plane 16 defines the region of planar congruity between the rear plane of portion 12 and the front plane of portion 18. Further, plane 16, as is indicated in FIG. 4, lies midway between points 28, 30, with the distance between each of these points in the plane being equal to $\lambda a/4$.

Considering now transformer portion 22 whose front plane, so-to-speak, is congruent with plane 20, the line of intersection between the inner surface of revolution, 22*b* (see FIG. 1), of this portion and the plane of FIGS. 1 and 4 is defined by the equation:

$$R_{itr}=A_1 \cos \theta_2$$

where $R_{itr}$ (Inside radius of the Transformer portion) is the radial distance between this line and axis 26.

The line which results from the intersection of the outer surface of revolution, 22*a* (also see FIG. 1), and the planes of FIGS. 1 and 4 is defined by the equation:

$$R_{otr}=A_3$$

where $R_{otr}$ (Outside radius of the Transformer portion) is the radial distance of such line from axis 26, and $A_3$ is a constant, the calculation of whose value will be explained shortly.

Let us consider now the steps involved in the design of that part of antenna 10 which has been described so far, namely, the main body of revolution (formed of polystyrene) in the antenna. To this end, let us continue to refer particularly to FIGS. 1 and 4, and to consider along with these two figures, the definitions and design parameters set forth in the lead section of this disclosure.

To begin with, it is convenient to choose a desired operating frequency for the antenna, such frequency being designated herein as $f_o$. Those skilled in the art of high-frequency antennas are well aware of a factor known as the K factor, designated K herein, which requires that design calculations be performed in conjunction with what is referred to herein as a design operating frequency $f_d$ that equals the desired operating frequency divided by K. Through repeated experiments with antennas constructed in accordance with this invention, the K factor for antenna 10, as is presented in the definitions and parameters section herein, has been found to equal to 0.9561.

Using the design operating frequency, and knowing the propagation velocities of electromagnetic radiation both in air and in the polystyrene material proposed for the antenna, the corresponding wavelengths in air and in the polystyrene, $\alpha_a$, $\alpha_1$, respectively, are calculated as indicated in the definitions section.

With these two wavelengths determined, the constants $A_1$ and $A_2$ are then calculated as shown in the definitions section.

With calculation of the constants $A_1$, $A_2$, completion of the design for converter portion 12 is possible through use of the formula presented above for gain:

$$\text{Gain} = 10 \log \left[ \frac{\text{input aperture area} \times K_1}{\text{output aperture area} \times K_a} \right]$$

where; $K_1$ is the dielectric constant of the antenna body material, and
$K_a$ is the dielectric constant of air.

The output aperture area is defined in plane 16 and is fixed by the equation:

$$\text{Output aperture area}=\pi(A_1)^2$$

The input aperture area is defined in plane 14, and constitutes the actual facial area in this plane of the right side of converter portion 12 in FIGS. 1 and 4.

A typical desired (and easily obtained) gain equals about 34-db, and using this figure, input aperture area is readily calculable. Experience has shown that selection of such a gain figure results in the input aperture area residing in a plane which lies about 87° to the right of plane 16 in FIGS. 1 and 4. This also results in a compact overall size for the converter portion.

Still to be designed in the body of the antenna is transformer portion 22, and the design here depends upon the impedance to be matched in a coaxial port provided for circuit 11. In the particular setting which is now being described, the requisite port for circuit 11 is shown generally in FIG. 1 at 32, with this port formed in a plastic board 34 which carries an inner ring-like coaxial conductor 36 and an outer ring-like coaxial conductor 38. Conductors 36, 38 are concentric, and are centered on axis 26, with board 34 and its associated circuit 11 appropriately attached to the back face of the antenna as shown.

The definitions and formulae section above sets forth the well-known calculation for the impedance of a coaxial port, such as port 32, and the same is calculated readily in accordance with the given formula. A typical coaxial impedance in the kind of apparatus now being described, and the impedance which characterizes port 32 is 50-ohms. As will be more fully explained, the cylindrical outside diameter of transformer portion 22 is determined, substantially, by the inside diameter of conductor 38, and accordingly, previously mentioned constant $A_3$ is equal to $D_o/2$. With this determination made, the location of plane 20 which defines the interface region between antenna portions 18, 22 becomes known.

The inside diameter of transformer portion 22, at the location of plane 24, is determined, substantially, by the outside diameter of conductor 36, and this is equal to $D_i/2$.

Accordingly, it should be apparent how the main body of antenna 10 is designed according to the invention.

Figure 2:
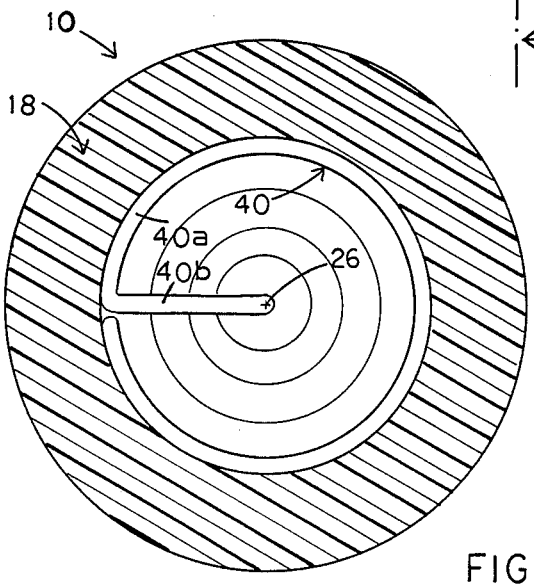
FIG. 2 is a reduced-scale, axial, cross-sectional view taken generally along the line 2—2 in FIG. 1.

Completing now a description of antenna 10, suitably mounted in an annular channel formed in the antenna body in plane 16 is a ring-like driven element, or expanse, 40 (see FIGS. 1 and 2). As can be seen particularly in FIG. 2, element 40 includes a generally nearly full circular ring portion **40*a* which, at one end thereof, joins with a radially inwardly extending arm portion 40*b* which, at the location of axis 26, joins with a finger portion 40*c* that extends rearwardly in the antenna coincident with axis 26 to couple directly, as shown in FIG. 1, with the inside of conductor 36. Ring portion 40*a*** has a length which substantially equals $\lambda_a$, and a nominal diameter which equals twice the constant $A_1$.

Figure 3:
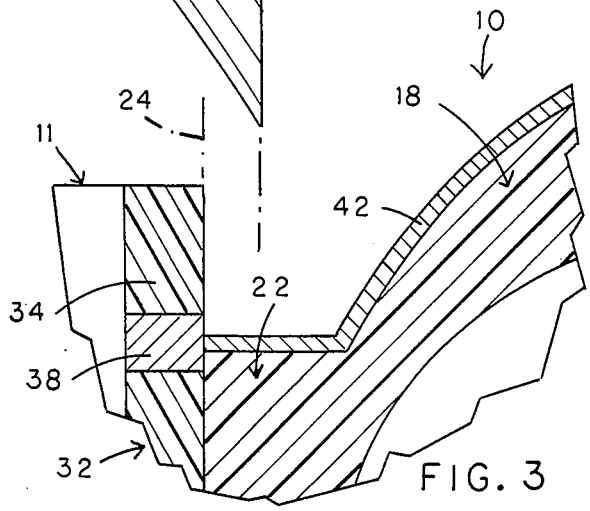
FIG. 3 is an enlarged detail of the area in FIG. 1 generally encompassed by the curved arrows 3—3.

Completing a description of the structure in antenna 10, and referring especially to FIG. 3, suitably formed on the radially outwardly facing surfaces of the main body in the antenna, surfaces **12*a*, 18*a*, 22*a*, is a thin electrically conductive layer 42, also referred to herein as a shield means. Where this layer extends to plane 24, it is conductively connected to conductor 38 in port 32**.

The antenna proposed by the present invention is now fully described. To provide a more specific illustration of one antenna which has been constructed and operated successfully according to the teachings of the invention, the same was designed for a desired operating frequency of approximately 4-gigahertz. Following the design criteria set forth above, the resulting antenna had a maximum diameter, in plane 14, of merely about 30-inches, and a maximum axial depth of merely about 1.5-inches. This antenna, in actual use, and despite its surprisingly small size, exhibited a gain of around 30-db, and an efficiency of about 88-percent.

As has been mentioned earlier, while the particular antenna shown and described herein has been related to a reception-mode of operation, those skilled in the art will readily appreciate that it may also operate in a transmission mode, with element 40 suitably driven by a source of radiation.

Addressing for a moment certain impedance characteristics which exist in antenna 10 progressing therethrough along axis 26 from plane 14 to plane 24, in the region extending between planes 14, 16, the apparent impedance of the antenna declines curvilinearly from very large (close to infinity) to about 12-ohms. In the region extending between planes 16, 20, the impedance is substantially constant at about 12-ohms. Between planes 20, 24, the impedance rises curvilinearly from about 12-ohms to the 50-ohms required for port 32.

There is thus proposed by the instant invention a unqiue, compact, high-gain, high-efficiency antenna.

While a preferred embodiment of this antenna has been disclosed herein, it is appreciated that certain variations and modifications may be made therein without departing from the spirit of the invention.

It is claimed and desired to secure by Letters Patent:

1. A nearfield/farfield, transmission/reception antenna for electromagnetic radiation of a selected wavelength, said antenna having a transmission/reception axis, and comprising a nearfield/farfield converter antenna portion having a body of revolution which is symmetrical with respect to said axis, and which is bounded by rear and front planes substantially normal to said axis, with inner and outer surfaces of revolution in said body extending between said planes, said inner surface, where it intersects a radial plane containing and extending to one side only of said axis, describing a curvilinear line defined by the equation $R_{ic}=A_1 \cos \theta_1$, where $R_{ic}$ is the distance of said line from said axis, $A_1$ is a constant relating to the propagation velocity in air of radiation at the selected operating wavelength for the antenna, and $\theta_1$ is the angle in degrees progressing from zero degrees away from said rear plane toward said front plane, and said outer surface, where it intersects the same radial plane, describing another curvilinear line defined by the equation $R_{oc}=A_2 \sec \theta_1$, where $R_{oc}$ is the distance of said other line from said axis, and $A_2$ is a constant relating to the propagation velocities both in air, and in the material forming said body of revolution, at said selected operating frequency, said inner and outer surfaces diverging progressing toward said front plane, a generally circular, planar, ring-like, conductive, driven expanse, having a nominal circumference substantially equaling said selected wavelength, and a nominal diameter substantially equaling $2A_1$, said expanse generally occupying said rear plane in a position symmetric with respect to said axis, and electromagnetic/electrostatic shield means distributed generally as a layer over said outer surface, impervious to radiation at said selected wavelength.

2. The antenna of claim 1 which further includes a nearfield terminator antenna portion formed of the same material as said converter antenna portion, having a body of revolution which is symmetrical with respect to said axis and which is partially bounded by a rear plane normal to said axis, and by a front plane normal to said axis and congruent with said rear plane in said converter antenna portion, said terminator antenna portion having inner and outer surfaces of revolution extending rearwardly away from its said front plane, with its said inner surface, where it intersects the same radial plane mentioned above, describing a curvilinear line defined by the equation $R_{it}=A_1 \cos \theta_2$, where $\theta_2$ is the angle in degrees progressing from zero degrees rearwardly away from said congruent planes, and said outer surface in said terminator antenna portion, where it intersects the same radial plane mentioned hereinabove, describing a further curvilinear line defined by the equation $R_{ot}=A_2 \cos \theta_2$.

3. The antenna of claim 2 which is designed for coupling to a coaxial port in an external circuit having a known coaxial impedance, which for this purpose further comprises a coupling-impedance transformer antenna portion formed of the same material as said converter and terminator antenna portions, and having a body of revolution which is symmetrical with respect to said axis, and which is partially bounded by a front plane normal to said axis and congruent with said rear plane in said terminator antenna portion, said transformer antenna portion having inner and outer surfaces of revolution extending rearwardly from its said front plane, with its said inner surface, where it intersects the same radial plane mentioned earlier, describing a curvilinear line defined by the equation $R_{itr}=A_1 \cos \theta_2$, and its said outer surface, where it intersects the same radial plane described above describing a straight line defined by the equation $R_{otr}=A_3$, where $A_3-R_{ot}$ at the angle $\theta_2$ which characterizes the angular location of the rear plane of said terminator antenna portion.

* * * * *